US008919457B2

(12) United States Patent
Hutchinson

(10) Patent No.: US 8,919,457 B2
(45) Date of Patent: Dec. 30, 2014

(54) APPARATUS AND METHOD FOR DETERMINING AXIAL FORCES ON A DRILL STRING DURING UNDERGROUND DRILLING

(76) Inventor: Mark Hutchinson, Meriden, CT (US)

( * ) Notice: Subject to any disclaimer, the term of this patent is extended or adjusted under 35 U.S.C. 154(b) by 318 days.

(21) Appl. No.: 13/098,246

(22) Filed: Apr. 29, 2011

(65) Prior Publication Data

US 2012/0103689 A1 May 3, 2012

Related U.S. Application Data

(60) Provisional application No. 61/330,198, filed on Apr. 30, 2010.

(51) Int. Cl.

| | |
|---|---|
| ***E21B 3/06*** | (2006.01) |
| ***E21B 47/00*** | (2012.01) |
| ***E21B 44/00*** | (2006.01) |

(52) U.S. Cl.

CPC ..... *E21B 47/0006* (2013.01); *E21B 44/00* (2013.01)

USPC ..... 175/27; 175/40; 175/57; 175/321; 175/106

(58) Field of Classification Search

USPC ..... 175/322

See application file for complete search history.

(56) References Cited

U.S. PATENT DOCUMENTS

| | | | |
|---|---|---|---|
| 3,345,832 | A | 10/1967 | Bottoms |
| 3,834,471 | A | 9/1974 | Bottoms |
| 3,871,193 | A | 3/1975 | Young |
| 3,898,815 | A | 8/1975 | Young |
| 3,947,008 | A | 3/1976 | Mullins |
| 3,968,473 | A | 7/1976 | Patton et al. |
| 4,133,516 | A | 1/1979 | Jurgens |
| 4,303,994 | A | 12/1981 | Tanguy |
| 4,324,297 | A | 4/1982 | Denison |
| 4,359,898 | A | 11/1982 | Tanguy et al. |
| 4,427,079 | A | 1/1984 | Walter |

(Continued)

FOREIGN PATENT DOCUMENTS

| | | | |
|---|---|---|---|
| GB | 2424018 | B | 5/2008 |
| WO | 2005047640 | A3 | 5/2005 |

OTHER PUBLICATIONS

Chen, S.L., "Field Investigation of the Effects of Stick-Slip, Lateral and Whirl Vibrations on Roller Cone Bit Performance," SPE 56439, presented at the 58.sup.th SPE ATCE, Houston, Oct. 3-6, 1991.

(Continued)

*Primary Examiner* — Jennifer H Gay
*Assistant Examiner* — Caroline Butcher
(74) *Attorney, Agent, or Firm* — Baker & Hostetler LLP

(57) ABSTRACT

An apparatus for determining the weight on a drill bit and axial forces along a drill string drilling though an earthen formation. The apparatus comprising an LVDT incorporated into a torsional bearing of a magneto-rheological damping system such that the LVDT senses the relative displacement and accelerations between a bearing mandrel portion and a bearing casing portion of the torsional damper. The LVDT is calibrated with respect to a spring in the damping system that resists relative motion between the bearing mandrel and bearing casing such that the output of the LVDT can be transformed into the force associated with the weight on the drill bit, and the same LVDT accelerations combined with the mass distribution along the drill string to determine axial stresses.

28 Claims, 7 Drawing Sheets

(56) References Cited

U.S. PATENT DOCUMENTS

| | | | |
|---|---|---|---|
| 4,445,578 | A | 5/1984 | Millheim |
| 4,479,564 | A | 10/1984 | Tanguy |
| 4,647,853 | A | 3/1987 | Cobern |
| 4,662,458 | A | 5/1987 | Ho |
| 4,715,451 | A | 12/1987 | Bseisu et al. |
| 4,739,841 | A | 4/1988 | Das |
| 4,760,735 | A | 8/1988 | Sheppard et al. |
| 4,761,889 | A | 8/1988 | Cobern et al. |
| 4,779,852 | A | 10/1988 | Wassell |
| 4,802,143 | A | 1/1989 | Smith |
| 4,813,274 | A | 3/1989 | DiPersio et al. |
| 4,821,563 | A | 4/1989 | Maron |
| 4,894,923 | A | 1/1990 | Cobern et al. |
| 4,958,517 | A | 9/1990 | Maron |
| 5,034,929 | A | 7/1991 | Cobern et al. |
| 5,133,419 | A | 7/1992 | Barrington |
| 5,251,708 | A | 10/1993 | Perry et al. |
| 5,382,373 | A | 1/1995 | Carlson et al. |
| 5,386,724 | A | 2/1995 | Das et al. |
| 5,816,344 | A | 10/1998 | Turner |
| 5,833,541 | A | 11/1998 | Turner et al. |
| 5,927,409 | A | 7/1999 | Turner |
| 5,931,000 | A | 8/1999 | Turner et al. |
| 6,068,394 | A | 5/2000 | Dublin |
| 6,102,681 | A | 8/2000 | Turner |
| RE36,848 | E | 9/2000 | Bui et al. |
| 6,123,561 | A | 9/2000 | Turner et al. |
| 6,134,892 | A | 10/2000 | Turner et al. |
| 6,216,533 | B1 | 4/2001 | Woloson et al. |
| 6,257,356 | B1 | 7/2001 | Wassell |
| 6,378,558 | B1 | 4/2002 | Pohl et al. |
| 6,547,016 | B2 | 4/2003 | Wassell |
| 6,714,138 | B1 | 3/2004 | Turner |
| 7,021,406 | B2 | 4/2006 | Zitha |
| 7,036,612 | B1 | 5/2006 | Raymond et al. |
| 7,219,752 | B2 * | 5/2007 | Wassell et al. ..... 175/321 |
| 7,287,604 | B2 | 10/2007 | Aronstam |
| 7,327,634 | B2 | 2/2008 | Perry |
| 7,377,339 | B2 | 5/2008 | Wassell |
| 2005/0056463 | A1 | 3/2005 | Aronstam |
| 2006/0215491 | A1 | 9/2006 | Hall |
| 2006/0243489 | A1 | 11/2006 | Wassell |
| 2010/0224410 | A1 | 9/2010 | Wassell |

OTHER PUBLICATIONS

Dykstra, M.W., "Experimental Evaluations of Drill Bit and Drill String Dynamics," SPE 28323, presented at the 61.sup.st SPE ATCE, New Orleans, Sep. 25-28, 1994.

Harvey, P., "The Design of Steerable Systems to Minimize the Adverse Effects of Motor Imbalance and Drillstring Forces," SPE 22565, presented at the 66.sup.th SPE ATCE, Dallas, Oct. 6-9, 1999.

Magnetic Ride Control, GM Tech Links, 4:1, pp. 1-2, Jan. 2002.

Spencer Jr., B.F., "Phenomenological Model of a Magnetorheological Damper," Journal of Engineering Mechanics, ASCE, 123 230-238, 1997.

Turner, W.E., "New Isolater for Controlling BHA Vibrations," Energy Week Conference, Houston, Jan. 27, 1997.

Warren, T.M., "Shock Sub Performance Tests," IADC/SPE 39323, presented at the 1998 IADC/SPE Drilling Conference, Dallas, Mar. 3-6, 1998.

Hutchinson, U.S. Appl. No. 61/330,198, filed Apr. 30, 2010.

Wassell, U.S. Appl. No. 12/398,983, Office Action dated Mar. 4, 2011.

Wassell, U.S. Appl. No. 12/398,983, Office Action response submitted Jun. 11, 2011.

Hutchinson, PCT/US2011/034571, International Search Report and Written Opinion mailed Jul. 26, 2011.

Hutchinson, U.S. Appl. No. 13/098,246, filed Apr. 29, 2011.

* cited by examiner

APPARATUS AND METHOD FOR DETERMINING AXIAL FORCES ON A DRILL STRING DURING UNDERGROUND DRILLING

This application claims priority to U.S. Provisional Application 61/330,198, filed Apr. 30, 2010, which is hereby incorporated by reference in its entirety.

The present invention relates to underground drilling, and more specifically, to an apparatus and method for determining axial forces acting on the drill string including both the weight on the drill bit as well as the axial forces acting on threaded pipe connections and on tubular bodies along the "drill string".

BACKGROUND OF THE INVENTION

Underground drilling, such as gas, oil, or geothermal drilling, generally involves drilling a bore through a formation deep in the earth. Such bores are formed by connecting a drill bit to long sections of threaded pipe, referred to as a "drill pipe," so as to form an assembly commonly referred to as a "drill string." The drill string extends from the surface to the drill bit at the bottom of the bore. The lowermost portion of the drill string is referred to as the bottom hole assembly.

The drill bit is rotated so that the drill bit advances into the earth, thereby forming the bore. In rotary drilling, the drill bit is rotated by rotating the drill string at the surface. Piston-operated pumps on the surface pump high-pressure fluid, referred to as "drilling mud," through an internal passage in the drill string and out through the drill bit. The drilling mud lubricates the drill bit, and flushes cuttings from the path of the drill bit. In the case of motor drilling, the flowing mud also powers a drilling motor which turns the bit, whether or not the drill string is rotating. The drilling mud then flows to the surface through an annular passage formed between the drill string and the surface of the bore.

Drill rig operators typically vary three parameters in order to optimize the rate of penetration of the drill bit into the rock and the vibration to which the drill string is subjected—(i) the rotary speed of the drill bit, (ii) the axial force driving the drill bit into the formation, referred to as the weight on bit ("WOB"), and (iii) the flow rate of the drilling mud. Although, increasing the WOB may increase the rate of penetration of the drill bit into the formation, it can also lead to inefficient rock cutting and excessive vibration, which can shorten the life of the bottom hole assembly components.

It is important, therefore, that the operator have accurate information concerning the magnitude of the WOB. An estimate of WOB may be obtained at the surface based on the difference between the known weight of the drill string and the hook load—that is, the tension of the drill string suspended from the derrick—corrected for the buoyant force of the drilling mud and a calculation of the drag. The calculation of drag experienced by the drill string is subject to inaccuracies, particularly in inclined or horizontal wells. Preferably, the WOB can be measured downhole, near the drill bit, by incorporating strain gauges into the bottom hole assembly. A system for measuring WOB using downhole strain gauges is described in U.S. Pat. No. 6,547,016, entitled "Apparatus For Measuring Weight And Torque An A Drill Bit Operating In A Well," hereby incorporated by reference herein in its entirety. Unfortunately, the output of the strain gauges can be affected by pressure and temperature, which can also lead to inaccuracies in the measurement of WOB.

Therefore, a need exists for an apparatus that can quickly and accurately measure the WOB during drilling.

The useful life of the components in the bottom hole assembly may depend on the stress levels to which such components are subjected as a result of vibration. Therefore, it would also be useful to provide the operator with information concerning the maximum stress levels being experienced by the bottom hole assembly.

SUMMARY OF THE INVENTION

In one embodiment, the apparatus determines the weight on a drill bit drilling though an earthen formation. The apparatus comprising an LVDT incorporated into a torsional bearing of a damping system such that the LVDT senses the relative displacement between a bearing mandrel portion and a bearing casing portion of the damper. The LVDT is calibrated with respect to the force vs. displacement of the spring in the damping system that resists relative motion between the bearing mandrel and bearing casing such that the output of the LVDT can be transformed into the force associated with the weight on the drill bit.

According to one embodiment, the invention comprises a method for determining the weight applied to a drill bit incorporated into a drill string to which a drill bit is attached for drilling a bore hole in an earthen formation that comprises the steps of (a) sensing the relative displacement between a first component coupled to the drill bit such that the first component moves axially in response to axial motion of the drill bit and a second component in coaxial relationship with the first component such that axial motion of the drill bit results in relative axial motion between the first and second components; (b) generating a signal representative of the sensed relative displacement; (c) generating a first force by deflecting a spring that opposes the relative axial motion between the first and second components, the spring having a predetermined relationship between deflection of the spring and the force generated by the deflection; and (d) determining the value of the first force based on the signal representative of the sensed relative displacement and the spring predetermined relationship; and determining the weight on the bit by determining the value of the first force. According to one embodiment, the relative displacement is sensed by an LVDT.

According to another embodiment, the invention comprises a system for determining the weight applied to the drill bit of a drill string, comprising (a) a first component coupled to the drill bit such that the first component transmits drilling torque to the drill bit and moves axially in response to axial motion of the drill bit; (b) a second component for transmitting drilling torque to the first component, the second component in coaxial relationship with the first component such that axial motion of the drill bit results in relative axial displacement between the first and second components; (c) a spring configured to generated a spring force in response to deflection thereof that resists the relative axial displacement between the first and second components, the spring having a predetermined relationship between the spring force and the deflection of the spring; (d) a sensor for sensing the relative axial displacement between the first and second components, the sensor generating a signal representative of the sensed relative axial displacement; and (e) a controller receiving the signal from the sensor, the controller having means for determining the weight on the drill bit based at ast in part on the relative axial displacement between the first and second components and the spring predetermined relationship.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show embodiments that are presently preferred. The invention is not limited, however, to the specific instrumentalities disclosed in the drawings.

DESCRIPTION OF PREFERRED EMBODIMENTS

The figures depict a preferred embodiment of an apparatus for measuring WOB according to the current invention incorporated into a vibration damping system 10 of a drill string 12. A vibration damping system is described more fully in U.S. Pat. Nos. 7,219,752 and 7,377,339, each entitled "System And Method For Damping Vibration In A Drill String," and in U.S. patent application Ser. No. 12/398,983, entitled "System And Method For Damping Vibration In A Drill String Using A Magneto-rheological Damper," filed Mar. 5, 2009, each of which are hereby incorporated by reference in their entirety.

Figure 1:
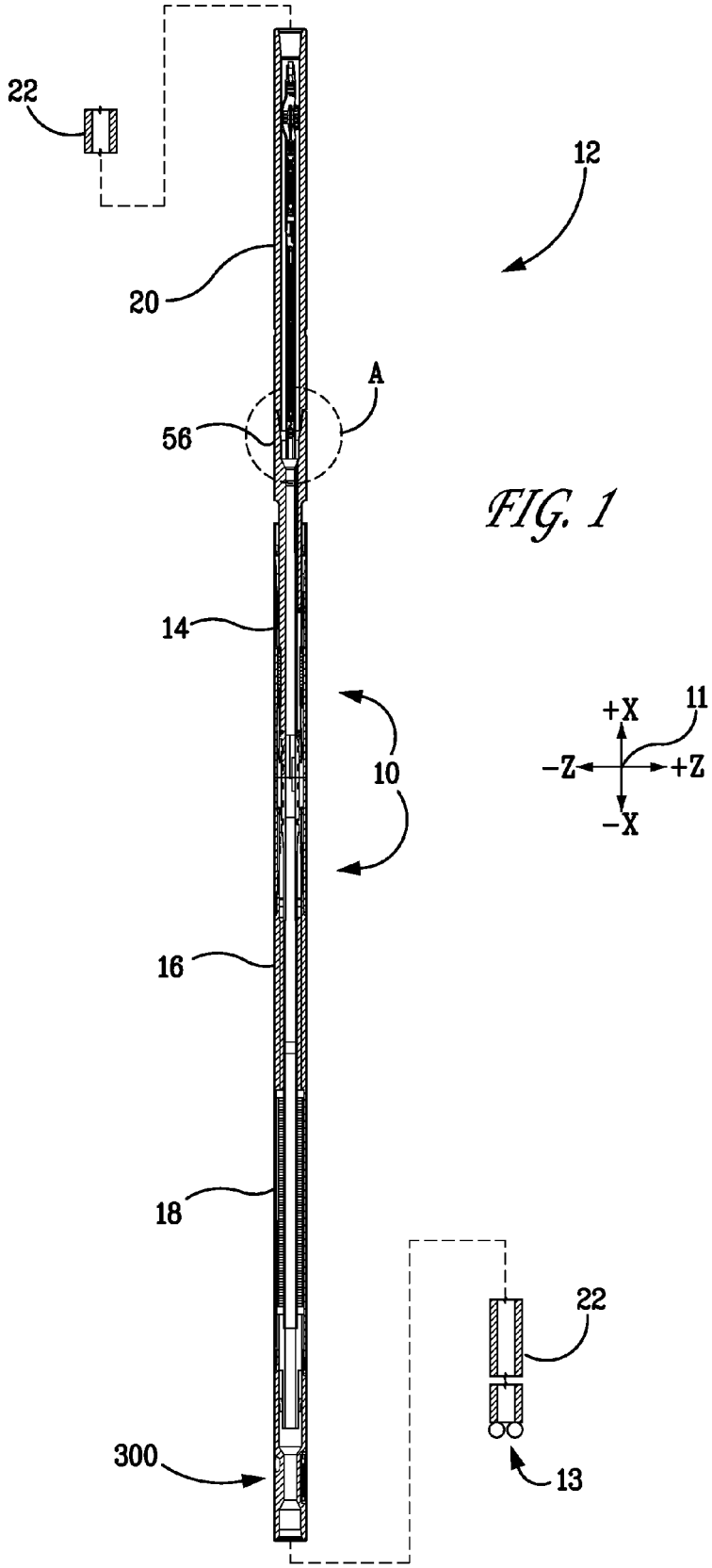
FIG. 1 is a longitudinal cross-sectional view of a preferred embodiment of a vibration damping system installed as part of a drill string incorporating the current invention.

As shown in FIG. 1, the vibration damping system 10 comprises a torsional bearing assembly 14, a valve assembly 16 containing a magnetorheological fluid ("MR fluid"), and a spring assembly 18. The valve assembly 16 and the spring assembly 18 can produce axial forces that dampen vibration of the drill bit 13. The magnitude of the damping force can be varied by the valve assembly 16 in response to the magnitude and frequency of the vibration, on a substantially instantaneous basis by applying a magnetic field to the MR fluid. The vibration damping assembly 10 can be mechanically coupled to the drill bit by drill pipe 23 that forms part of the drill string 12. Although as shown, the torsional bearing 14 is located uphole of the MR valve assembly 16 and the spring assembly 18 is located below the MR valve assembly, these components could be arranged in other orders, for example, the torsional bearing 14 could be located downhole of the MR valve assembly 16 and the spring assembly 18 is located uphole of the MR valve assembly.

The torsional bearing assembly 14 facilitates the transmission of drilling torque, for example from a rotary drive located at the surface, to the drill bit 13 while permitting relative axial movement between the portions of the drill string 12 located up-hole and down-hole of the vibration damping system 10. Moreover, the torsional bearing assembly 14 can transform torsional vibration of the drill bit 13 into axial vibration. The axial vibration, in turn, can be damped by the valve assembly 16 and the spring assembly 18.

Figure 2:
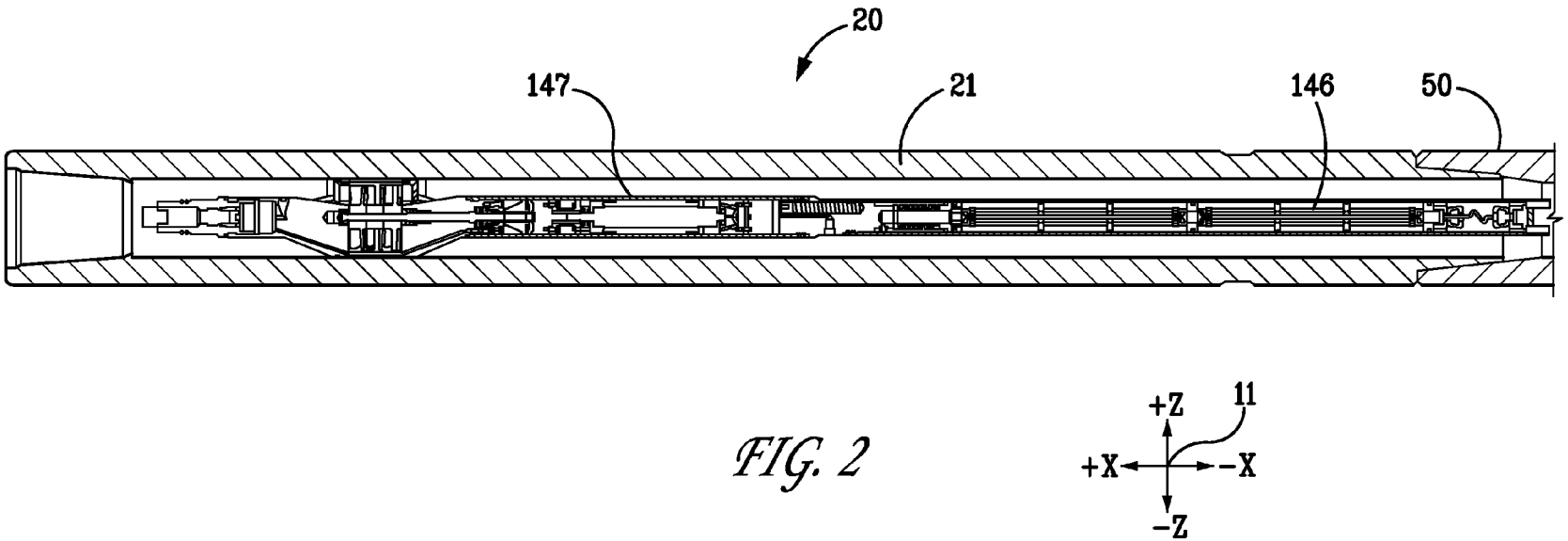
FIG. 2 is a longitudinal cross-sectional view of a turbine alternator assembly of the drill string shown in FIG. 1.

The vibration damping system 10 can be mechanically and electrically connected to a turbine-alternator module 20 located up-hole of the vibration damping system 10 (see FIGS. 1 and 2). (The up-hole and down-hole directions correspond respectively to the "+x" and "−x" directions denoted in the figures.) The turbine-alternator module 20 can provide electric power for the vibration damping system 10.

Figure 3:
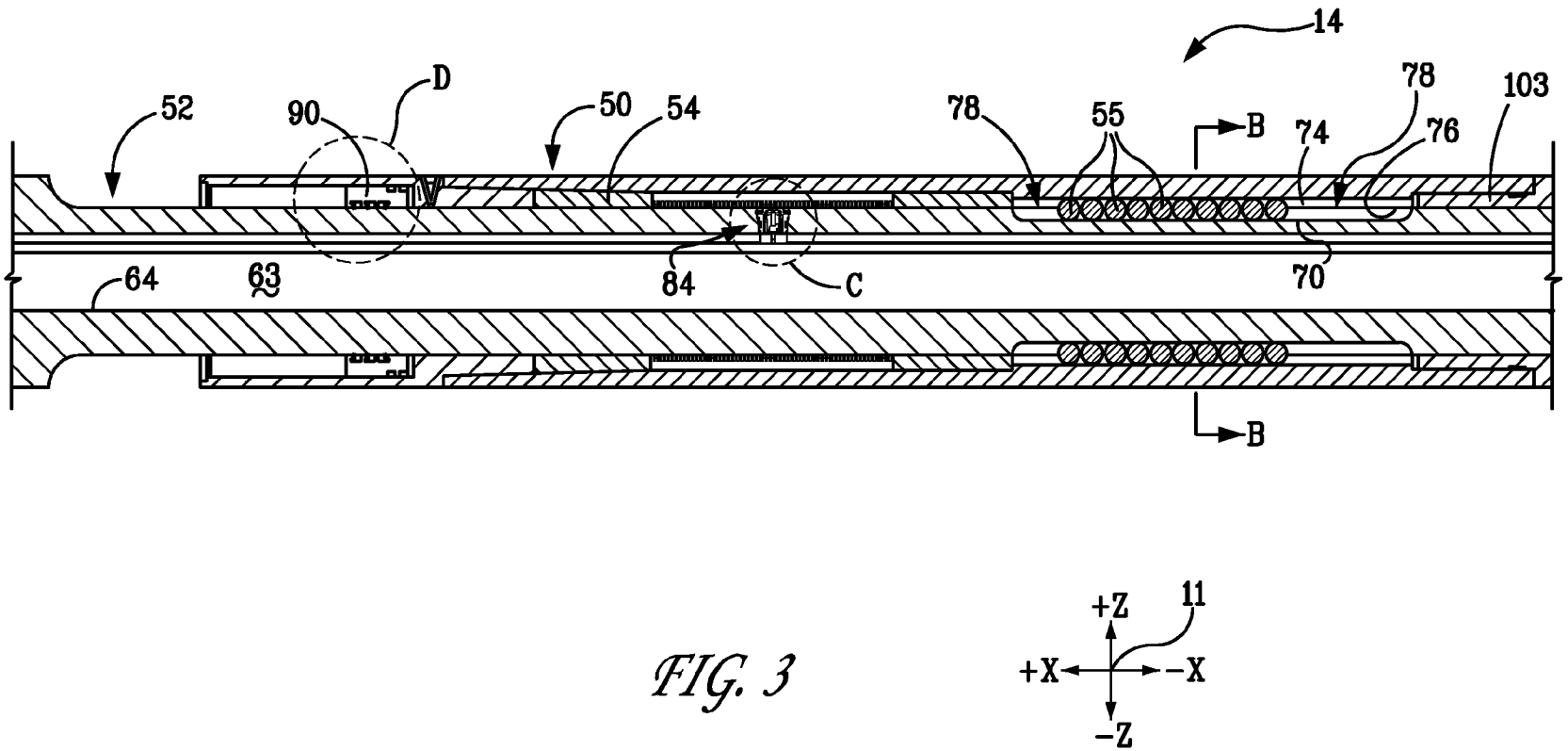
FIG. 3 is a longitudinal cross-sectional view of a torsional bearing assembly of the vibration damping system shown in FIG. 1

As shown in FIG. 3, the torsional bearing assembly 14 comprises a casing 50 and a bearing mandrel 52. The bearing casing 50 can translate axially in relation to the bearing mandrel 52. The torsional bearing assembly 12 also comprises a plurality of ball bearings 55 for transmitting torque between the bearing mandrel 52 and the bearing casing 50.

Drilling torque is transmitted to an outer casing 21 of the turbine-alternator module 20 by way of a drill collar 22 located up-hole of the turbine-alternator module 20 (see FIG. 1). The bearing mandrel 52 is secured to the outer casing 21 so that the drilling torque is transferred to the bearing mandrel 52. The bearing mandrel 52 therefore rotates with the outer casing 21.

The bearing mandrel 52 has a plurality of grooves 70 formed in an outer surface thereof. Preferably, the grooves 70 are substantially straight. The bearing casing 50 has a plurality of grooves 74 formed on an inner surface 76 thereof. Each corresponding groove 70 and groove 74 define a passage 78 for ten of the ball bearings 55. The centerline of each groove 70 may be parallel to the centerline, or oriented in relation to the centerline of the bearing mandrel 52 at a helix angle "β". This will cause the two halves of the torsional bearing to move relative to each other in response to a torsional force as well as an axial one. Preferably, the helix angle 13 lies within a range of approximately four degrees to approximately fifteen degrees.

Drilling torque transmitted to the bearing mandrel 52 from the turbine-alternator assembly 20 exerts a tangential force, i.e., a force coincident with the "y-z" plane, on the ball bearings 55. The tangential force is transferred to the ball bearings 55 by way of the walls of the grooves 70. The ball bearings 55 transfer the torque to the bearing casing 50 by way of the walls of the grooves 74, thereby causing the bearing casing 50 to rotate with the bearing mandrel 52. Movement of the ball bearings 55 along the length of their respective passage 78 can facilitate relative movement between the bearing mandrel 52 and the bearing casing 50 in the axial direction. Hence, the torsional bearing assembly 14 substantially decouples the portion of the drill string 12 down-hole of the vibration damping system 10 from axial movement of the portion of the drill string 12 up-hole of the vibration damping system 10, and vice versa. The bearing mandrel 52 and the bearing casing 50 are restrained from relative tangential movement, i.e., movement in the "y-z" plane, due to the substantially straight geometry of the passages 78, and because the ball bearings 55 remain at a substantially constant distance from the centerline of the bearing mandrel 52 as the ball bearings 57 translate along their associated passages 78. The bearing casing 50 is coupled to the drill bit 13 so that torque transmitted to bearing mandrel 52 by the turbine alternator module 20 is transmitted to the drill bit 13 by the bearing casing of the torsional bearing 14.

The bearing casing 50 is connected to the drill bit 13 by way of the MR valve assembly 16, the spring assembly 18, and the portion of the drill string 12 located down-hole thereof. The bearing casing 50 therefore rotates with the drill bit 13, and translates with the drill bit 13 in the axial direction. Hence, axial and torsional vibrations of the drill bit 13 are transmitted up-hole, by way of the drill string 12, to the bearing casing 50, which causes relative motion between the bearing casing and the bearing mandrel 52.

Figure 5:
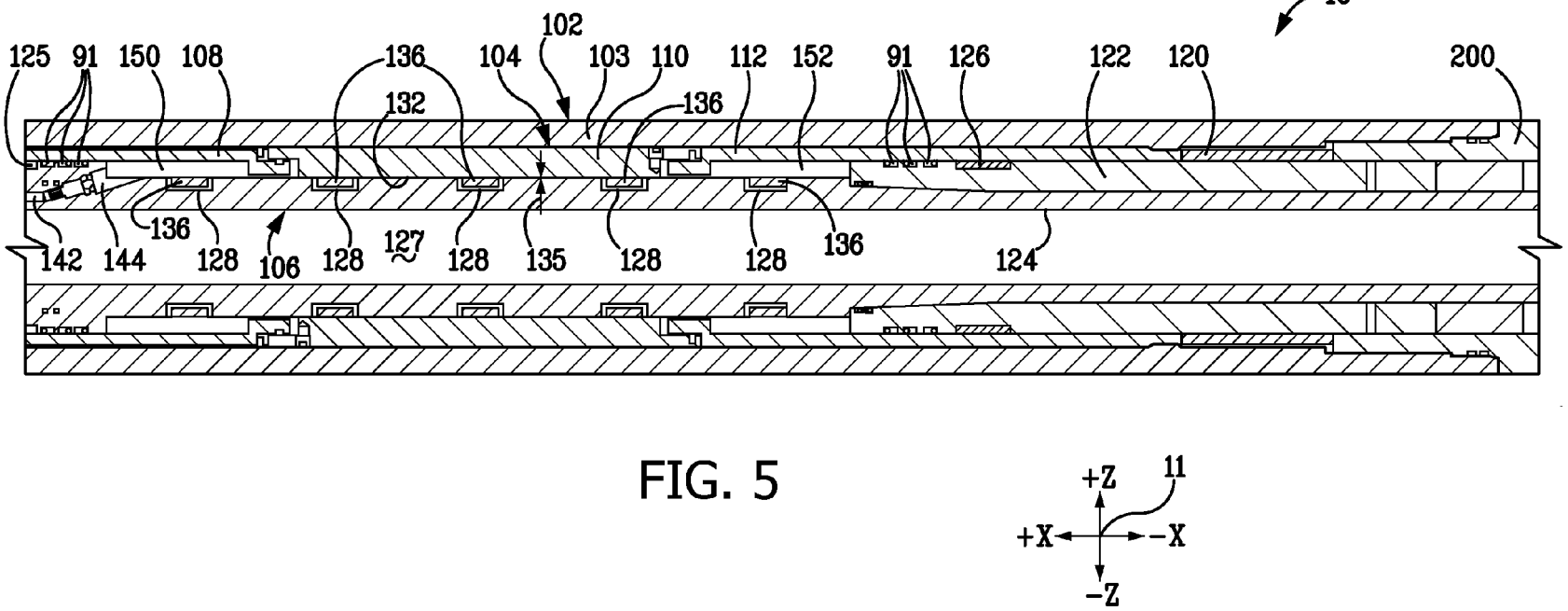
FIG. 5 is a longitudinal cross-sectional view of a valve assembly of the vibration damping system shown in FIG. 1.

The MR valve assembly 16 is located immediately down-hole of the torsional bearing assembly 12 (see FIGS. 1 and 5). The valve assembly 16 comprises a valve casing 102. The valve casing 102 comprises an outer casing 103, and a housing 104 positioned within the outer casing 103. The valve assembly 16 also comprises a coil mandrel 106 positioned within the valve casing 102. An inner surface 124 of the coil mandrel 106 defines a passage 127 for permitting drilling mud to flow through the valve assembly 16. The passage 127 adjoins a passage 63 formed in the bearing mandrel 52. A first portion 108 of the housing 104 and the coil mandrel 106 define a circumferentially-extending first, or up-hole, chamber 150. A second portion 112 of the housing 104 and the coil mandrel 106 define a circumferentially-extending second, or down-hole chamber 152. The first and second chambers 150, 152 are filled with a MR fluid.

MR fluids typically comprise non-colloidal suspensions of ferromagnetic or paramagnetic particles. The particles typically have a diameter greater than approximately 0.1 microns. The particles are suspended in a carrier fluid, such as mineral oil, water, or silicon. Under normal conditions, MR fluids have the flow characteristics of a conventional oil. In the presence of a magnetic field, however, the particles suspended in the carrier fluid become polarized. This polarization cause the particles to become organized in chains within the carrier fluid.

The particle chains increase the fluid shear strength (and therefore, the flow resistance or viscosity) of the MR fluid. Upon removal of the magnetic field, the particles return to an unorganized state, and the fluid shear strength and flow resistance returns to its previous value. Thus, the controlled application of a magnetic field allows the fluid shear strength and flow resistance of an MR fluid to be altered very rapidly. MR fluids are described in U.S. Pat. No. 5,382,373 (Carlson et al.), which is incorporated by reference herein in its entirety.

The valve assembly 16 also comprises a sleeve 122. The sleeve 122 is concentrically disposed around portion of the coil mandrel 106, proximate the down-hole end thereof. The sleeve 122 is secured to the coil mandrel 106 so that the sleeve 122 rotates, and translates axially with the coil mandrel 106. The coil mandrel 106 and a third portion 110 of the housing 104 are sized so that a clearance, or gap 135 exists between an inner surface 132 of the second portion 110, and the adjacent outer surface portions 130 of the coil mandrel 106.

Coils 136 of the MR valve 16, each of which is wound within a recesses 128, generate a magnetic field in response to the passage of electrical current therethrough. The coils 136 can be electrically connected to a controller 146 mounted in the turbine-alternator assembly 20 (see FIG. 2). The controller 146 can be powered by an alternator 147 of the turbine-alternator assembly 20. The controller 146 can supply an electrical current to the coils 136. The controller 146 can control the magnitude of the electrical current to vary the strength of the aggregate magnetic field generated by the coils 136.

The first chamber 150 and the second chamber 152 are in fluid communication by way of the gap 135 formed between the inner surface 132 of the second portion 110, and the adjacent outer surface portions 130 of the coil mandrel 106. Hence, the MR fluid can move between the first and second chambers 150, 152 by way of the gap 135.

The outer portion 103 of the valve casing 102 is coupled at its uphole end to the bearing mandrel 52, as shown in FIG. 3. The valve casing outer portion 103 is coupled at its downhole end to the spring casing 200 of the spring assembly 18, discussed below. The spring assembly is coupled to the drill bit 13 by the portion of the drill pipe 23 located down hole of the vibration damping system 10. The valve casing outer portion 103 therefore rotates, and translates axially with the drill bit 13.

The coil mandrel 106 of the valve is coupled at its uphole end to the bearing bearing mandrel 52. The valve coil mandrel 106 is coupled at its downhole end to the spring mandrel 202 of the spring assembly 18, discussed below. Thus, the coil mandrel 106 and the sleeve 122 are substantially decoupled from axial movement of the valve casing 102 by the torsional bearing assembly 14.

The above-noted arrangement causes the coil mandrel 106 and the sleeve 122 to reciprocate within the housing 104 in response to vibration of the drill bit 13. This movement alternately decreases and increases the respective volumes of the first and second chambers 150, 152. In particular, movement of the coil mandrel 106 and the sleeve 122 in the up-hole direction in relation of the housing 104 increases the volume of the first chamber 152, and decreases the volume of the second chamber 150. Conversely, movement of the coil mandrel 106 and the sleeve 122 in the down-hole direction in relation of the housing 104 decreases the volume of the first chamber 152, and increases the volume of the second chamber 150. The reciprocating movement of the coil mandrel 106 and the sleeve 122 within the housing 104 thus tends to pump the MR fluid between the first and second chambers 150, 152 by way of the gap 135.

The flow resistance of the MR fluid causes the valve assembly 16 to act as a viscous damper. In particular, the flow resistance of the MR fluid causes the MR fluid to generate a force (opposite the direction of the displacement of the coil mandrel 106 and the sleeve 122 in relation to the housing 104) that opposes the flow of the MR fluid between the first and second chambers 150, 152. The MR fluid thereby resists the reciprocating motion of the coil mandrel 106 and the sleeve 122 in relation to the housing 104. This resistance can dampen axial vibration of the drill bit 13.

The magnitude of the damping force generated by the MR fluid is proportional a function of the flow resistance of the MR fluid and the frequency of the axial vibration. The flow resistance of the MR fluid, as noted above, can be increased by subjecting the MR fluid to a magnetic field. Moreover, the flow resistance can be varied on a substantially instantaneous basis by varying the magnitude of the magnetic field.

Figure 4:
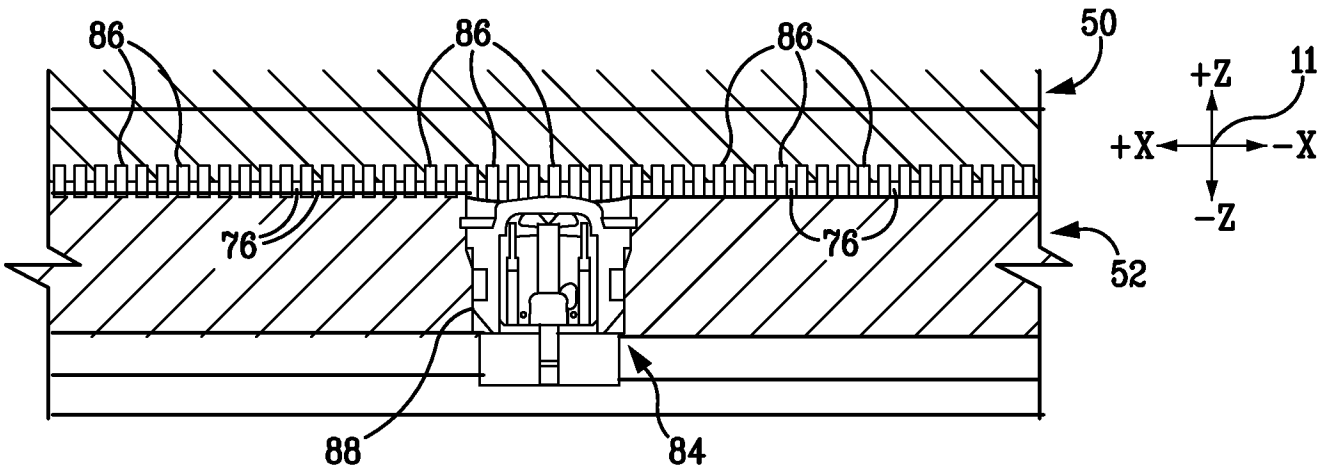
FIG. 4 is an enlarged view of the area designated "C" in FIG. 3, showing the LVDT according to the current invention.

According to the current invention, a linear variable displacement transducer (LVDT) 84, shown in FIG. 4, is incorporated into the torsional bearing assembly 14. The LVDT 84 comprises an array of axially-spaced magnetic elements 86 embedded in the bearing casing 50, proximate the inner surface 76 thereof. The LVDT 84 also comprises a sensor 88, such as a Hall-effect sensor, mounted on the bearing mandrel 52 so that the sensor 88 is magnetically coupled to the magnetic elements 86. The LVDT 84 is electrically connected to the controller 146. The LVDT 84 provides an input to the controller 146 in the form of an electrical signal indicative of the relative axial position, velocity, and acceleration of the bearing casing 50 and the bearing mandrel 52, as noted above. The bearing casing 50 is connected the drill bit 13, and is substantially decoupled from axial movement of the bearing mandrel 52. Hence, the output of the LVDT 84 is responsive to the magnitude and frequency of the axial vibration of the drill bit 13.

Moreover, the rate of change of the LVDT output is a function of the rate of change in the relative positions of the sensor 88 and the array of magnetic elements 86. Hence, the LVDT 84 can provide an indication of the relative axial displacement, velocity, and acceleration of the bearing casing 50 and the bearing mandrel 52.

The controller 146 can process the input from the LVDT 84, and generate a responsive output in the form of an electrical current directed to the coils 136 on a substantially instantaneous basis. Hence, the valve assembly 16 can generate a damping force in response to vibration of the drill bit 13 on a substantially instantaneous basis. The valve assembly 16 and the controller 146 can automatically increase or decrease the amount of damping exerted on the drill bit 13 to reduce vibration of the drill bit 13, which reflects these same parameters for the motion of the drill bit relative to the drill string.

Figure 6:
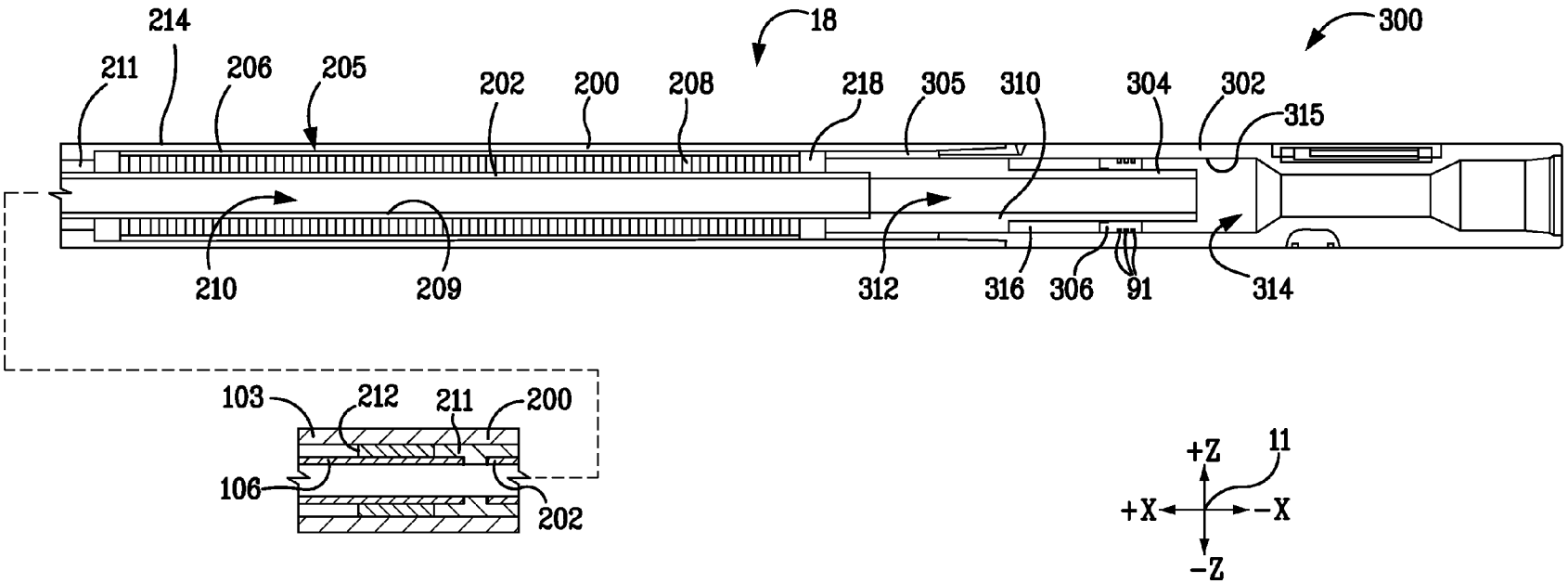
FIG. 6 is a longitudinal cross-sectional view of a spring assembly of the vibration damping system shown in FIG. 1.

The spring assembly 18 is located immediately down-hole of the valve assembly 16 (see FIGS. 1 and 6). The spring assembly 18 can exert a restoring force on the drill bit 13 in response to axial movement of the drill bit 13 (the vibration damping assembly 10 thus behaves as a spring-mass-damper system).

The spring assembly 18 comprises a spring casing 200. The up-hole end of the spring casing 200 is secured to the outer casing 103 of the valve casing 102 so that drilling torque is transferred to the spring casing 200. The down-hole end of the spring casing 200 is secured to a casing 302 of a compensation module 300, so that the drilling torque is transferred from the spring casing 200 to the casing 302 of the compensation module 300, which is coupled to the drill bit 13 by the section of drill pipe 22, as shown in FIG. 1. The spring casing 200 and the casing 302 therefore rotate, and translate axially with the valve casing 102.

The spring assembly 18 also includes a spring mandrel 202, and a spring stack 205. The uphole end of the spring mandrel 202 is coupled to the downhole end of the valve mandrel 106. The spring stack 205 preferably comprises a first spring 206, and a second spring 208. (The spring stack 205 can include more or less than two springs in alternative embodiments.)

The spring casing 200, the spring mandrel 202, and the spring stack 205 are disposed in a substantially coaxial relationship. The first and second springs 206, 208 are positioned in series, i.e., end to end, within the spring casing 202. The spring mandrel 202 is positioned within the first and the second springs 206, 208. (The relative axial positions of the first and second springs 206, 208 can be reversed from those depicted in FIG. 6 in alternative embodiments.)

The spring mandrel 202 can translate axially in relation to the spring casing 200. An inner surface 209 of the spring mandrel 202 defines a passage 210 for permitting drilling mud to flow through the spring assembly 18. The first and the second springs 206, 208 preferably are Belleville springs (other types of springs can be used in the alternative). Preferably, the second spring 208 is stiffer, i.e., has a higher spring rate, than the first spring 206. This feature is believed to facilitate transmission of axial vibration from the drill bit 13 to the valve assembly 14 under a relatively wide range of weight-on-bit conditions. (Other spring configurations are possible in alternative embodiments. For example, one relatively soft Belleville spring can be positioned between two relatively hard Belleville springs in one possible alternative embodiment.)

The compensation module 300 also includes a mandrel 304, and a sliding compensation piston 306. The compensation piston 306 is positioned around a down-hole portion of the mandrel 304. The mandrel 304 of the compensation module 300 extends into the down-hole portion of the spring casing 200. The mandrel 304 is supported, in part, by a radial bearing 305 positioned between the mandrel 304 and the spring casing 200. A down-hole end of the bearing 305 abuts an forward edge of the casing 302, thereby restraining the bearing 305 in the rearward direction. An inner surface 310 of the mandrel 304 defines a passage 312 for permitting drilling mud to flow through the mandrel 304 and into the compensation module 300. The drilling mud, upon exiting the passage 312, enters a passage 314 defined by an inner surface 315 of the mandrel 304. (The drilling mud in the passage 314 acts against the down-hole side of the compensation piston 306.

A coupling 211 is positioned within the spring casing 200, proximate an up-hole end thereof. The coupling 211 receives the down-hole end of the coil mandrel 106, and the up-hole end of the spring mandrel 202. The coil mandrel 106 and the spring mandrel 202 are secured to the coupling 211 so that the spring mandrel 202 rotates, and translates axially with the coil mandrel 106.

A first spacer 212 is located immediately up-hole of the coupling 211, and separates the coupling 211 from the sleeve 122 of the valve assembly 16. A second spacer 214 is positioned between the coupling 211, and the first and spring 206. The first and the second springs 206, 208 urge the second spacer 214 into a lip 216 of the spring casing 200. Contact between the second spacer 214 and the lip 216 prevents movement of the second spacer 214 past the lip 216, and thereby restrains the first and second springs 206, 208 in the forward direction.

A third spacer 218 is positioned between the second spring 208, the mandrel 304, and the bearing 305. The first and the second springs 206, 208 urge the third spacer 218 into the forward edge of the bearing 305. Contact between the third spacer 218 and the bearing 305 prevents movement of third spacer 218 in the down-hole direction, and thereby restrains the first and second springs 206, 208 in the down-hole direction.

The first and the second springs 206, 208 therefore are constrained between the second and third spacers 214, 218. This arrangement causes the first and second springs 206, 208 to function as double (dual) action springs. In particular, movement of the spring casing 200 in the down-hole direction in relation of the spring mandrel 202 causes the lip 216 of the spring casing 200 to urge the second spacer 214 in the down-hole direction. (This type of relative movement can occur during vibration-induced movement of the drill bit 13 in the down-hole direction.)

The second spacer 214, in turn, urges the first and second springs 206, 208 in the down-hole direction, against the third spacer 218. The third spacer 218, in response, acts against the mandrel 304 of the compensation assembly 300 in the down-hole direction. The mandrel 304, which is connected to the up-hole portion of the drill string 12 by way of the spring mandrel 202, coil mandrel 106, and bearing mandrel 52, reacts to the force exerted thereon by the third spacer 218.

The first and second springs 206, 208 therefore become compressed in response to the movement of the spring casing 200 in the down-hole direction. The resulting spring force acts against the spring casing 200 (and the drill bit 13) in the up-hole direction, by way of the lip 216. The magnitude of the spring force is a function of the deflection of the spring casing 200 and the drill bit 13.

Movement of the spring casing 200 in the up-hole direction in relation of the spring mandrel 202 causes the forward edge of the casing 302 (which is secured to the spring casing 200) to act against the bearing 305. (This type of relative movement can occur during vibration-induced movement of the drill bit 13 in the up-hole direction.)

The bearing 305, in turn, urges the third spacer 218 and the adjacent first and second springs 206, 208 in the up-hole direction, toward the second spacer 214 and the coupling 211. The coupling 211, which is connected to the up-hole portion of the drill string 12 by way of the spring coil mandrel 106 and the bearing mandrel 52, reacts the force exerted thereon by the second spacer 214.

The first and second springs 206, 208 therefore become compressed in response to the movement of the spring casing 200 in the up-hole direction. The resulting spring force acts against the spring casing 200 (and the drill bit 13) in the down-hole direction, by way of the bearing 305 and the casing 302. The magnitude of the spring force is a function of the deflection of the spring casing 200 and the drill bit 13.

The spring assembly 218 therefore can exert a restoring force on the drill bit 13 in both the up-hole and down-hole directions. The dual-action characteristic of the first and second springs 206, 208, it is believed, makes the spring assembly 218 more compact than a comparable spring assembly that employs multiple single-action springs.

Moreover, the spring assembly 18 is adapted for use under both relatively low and relatively high weight-on-bit conditions due to the combined use of a relatively soft and a relatively hard spring. In particular, it is believed that Belleville washers of first (softer) spring 206 deflect (compress) when the weight-on-bit, i.e., the down-hole force, on the drill bit 13 is relatively low. The Belleville washers of the second spring 208 do not deflect substantially under low weight-on-bit conditions. The spring assembly 18 thus exerts a relatively low restoring force on the drill bit 13 under relatively low weight-on-bit conditions. This feature permits axial vibrations of the drill bit 13 to be transmitted to, and damped by the valve assembly 14.

Further, increasing the WOB further compresses the Belleville washers of the first spring 206, until the Belleville washers of the first spring 206 become fully compressed. Additional increases in the WOB cause the Belleville washers of the second spring 208 to deflect (compress). The relatively high spring constant of the second spring 208 increases the restoring force exerted by the spring assembly 18 on the drill bit 13 as the Belleville washers of the second spring 208 begin to deflect to deflect. The spring assembly 18 thus facilitates transmission of axial vibrations to the valve assembly 16 under both relatively low and relatively high WOB conditions, while permitting axial vibration to be transmitted to and damped by the valve assembly 14 when the WOB is relatively low.

According to the current invention, the output of the LVDT 84, incorporated into the torsional bearing assembly 14 for use in controlling the MR valve 16, is also used to determine the WOB based on the relative displacement of the bearing casing 50 and the bearing mandrel 52 in the axial direction (see FIG. 3). According to one embodiment, software for performing the method of determining the WOB based on the output of the LVDT is preferably installed into a processor, incorporated into the controller 146, that executes the software so as to perform the methods discussed below.

An increase in WOB will cause the bearing mandrel 52 to be displaced in the downhole direction relative to the bearing casing 50, which change in relative displacement is sensed by the LVDT 84. The change in displacement of the bearing mandrel 52 will, in turn, cause the valve mandrel 106 to be displaced in the downhole direction relative to the valve casing 102. The change in displacement of the valve mandrel 106 in the downhole direction will, in turn, cause MR fluid to flow from chamber 50 to chamber 52 via passage 135, and will cause the spring mandrel 202 to be displaced in the downhole direction relative to the spring casing 200. The change in displacement of the spring mandrel 202 relative to the spring casing 200 will cause compression of the spring stack 205 and the generation of a spring force opposing such relative motion that is proportional to the change in relative displacement. Thus, increasing WOB results in a change in displacement between the bearing casing 50 and the mandrel 52 that is resisted by the spring assembly 18 and detected by the LVDT 84. If the spring constant of the spring assembly 18 is a constant, the drill string can be suspended from the rig, with the drill bit not in contact with the formation, so as to establish the output of the LVDT that represents the position of the bearing casing 50 relative to the bearing mandrel 52 when the WOB equals zero. During drilling, the change in output of the LVDT 84 from this "zero" value can be transformed, for example, by software in the controller 146, to the value of the WOB by multiplying the change in displacement associated with the change in the LVDT output by the spring constant of the spring assembly 18—for example, if the change in the LVDT output indicated a change in relative axial displacement of the bearing casing and bearing mandrel of 0.5 inch and the spring constant of the spring assembly were 50,000 pounds per inch, then the WOB would be calculated as:

$$\text{WOB}=0.5\ \text{inch}\times 50{,}000\ \text{pounds per inch}=25{,}000\ \text{lb}.$$

If the spring constant of the spring assembly 18—that is, the ratio of the force generated by the spring to the deflection of the spring—is non-linear, the spring assembly would be calibrated at the surface to establish the relationship between the output of the LVDT and the force required to create a given displacement of the bearing casing 50 relative to the bearing mandrel 52. If drill string components of the bottom hole assembly are placed between the bit and LVDT sensor, then the calculated amount of weight on the bit should be compensated for the buoyancy and inclination effects of the drill string components placed beneath the LVDT sensor.

As noted above, the grooves in the bearing mandrel 52 may be not be parallel to the drill string axis, which will introduce a torsional component to the spring compression force that does not result from the WOB. However, by using a helix angle $\beta$ that is relatively small, the error introduced by this torsional component can be ignored. Alternatively, when operating in a slide drilling mode, in which the influence of unknown frictional forces is greatest, the WOB could be determined when the tool is not rotating to eliminate the effect of the torsion component.

Preferably, the output of the LVDT is both stored in a downhole memory device, incorporated into the controller 146, for example, and transmitted to the surface on a real time basis using MWD technology, such as mud pulse telemetry or electromagnetic or wired pipe. Mud pulse telemetry systems are described more fully in U.S. Pat. No. 6,714,138, entitled "Method And Apparatus For Transmitting Information To The Surface From A Drill String Down Hole In A Well," U.S. Pat. No. 7,327,634, entitled "Rotary Pulser For Transmitting Information To The Surface From A Drill String Down Hole In A Well," and U.S. Patent Application Publication No. 2006/0215491, entitled "System And Method For Transmitting Information Through A Fluid Medium," each of which is incorporated by reference herein in its entirety. At the surface, the WOB data are then recorded and displayed for the driller and others for use in real-time optimization of the drilling process.

In the embodiment discussed above, the controller 146 determines the WOB using only the displacement between the bearing casing 50 and bearing mandrel 52, as sensed by the LVDT 84, together with the spring constant of the spring assembly 18. However, in some embodiments, the controller 146 could also take into account the affect of the viscous force generated by the MR fluid as a result of the relative axial velocity between the bearing casing and bearing mandrel, for example as determined from the output of the LVDT, in determining the WOB. If the bearing casing 50 and bearing mandrel 52 are moving relative to each other then there is a force required to displace MR fluid through the narrow gap 135 in the MR valve so that the MR fluid can flow between the chambers 50 and 52. According to one embodiment of the invention, this viscous force is determined and included in the determination of the WOB. The viscosity of the MR fluid will typically have a known relationship to the strength of the magnetic field generated by the coils, for example, the viscosity may be proportional to the strength of the magnetic field. The strength of the magnetic field will, in turn, be a function of the current supplied to the coils, the greater the current, the stronger the magnetic field and the greater the viscosity of the MR fluid. According to one embodiment, this viscous force is determined by determining the viscosity of the MR fluid by sensing the electrical current applied to the coils 136.

In addition to the viscous force from the MR fluid, the magnetic field created by the coils 136 gives the MR fluid a magnetic "stiffness" that must be overcome before the MR fluid begins to flow. According to one embodiment of the invention, the force required to overcome this magnetic stiffness is also included in the determination of the WOB.

Figure 7:
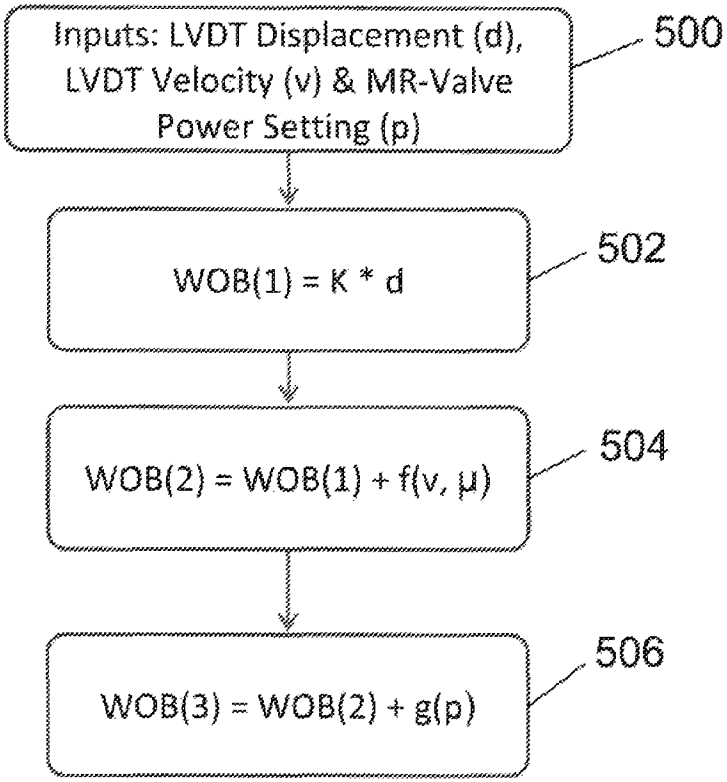
FIG. 7 is a flowchart showing the determination of WOB according to one embodiment of the invention.

A flow chart for the method of determining WOB is shown in FIG. 7. In step 500, the algorithm receives as inputs (i) a value that is representative of the change in relative displacement "d" between the bearing casing 50 and bearing mandrel 52 based on the output of the LVDT, (ii) a value that is representative of the relative velocity "v" between the bearing casing 50 and bearing mandrel 52 based on the output of the LVDT, and (iii) a value that is representative of the power "p" supplied to the coils 136 of the MR valve assembly 16.

In step 502, an initial determination of the WOB, WOB(1) is made by multiplying the spring constant K of the spring assembly 18 by the change in relative displacement d. Optionally, in step 504, a refined value of the WOB, WOB(2), is made by applying a correction factor $f(v, \mu)$ to WOB(1) that is a function of the relative velocity v and the viscosity $\mu$ of the MR fluid. Optionally, in step 506, a further refined value of WOB, WOB(3) is made by applying a second correction factor g(p) to WOB(2) that is a function of the electrical power p supplied to the coils. The values off and g are functions of the specific geometry of the MR valve assembly 16.

In another embodiment, the group parameters (e.g. peak values, standard deviation, skewness or kurtosis) of the LVDT 84 output are used to determine the dynamic axial accelerations and maximum loading on the drilling tools. When using this method, maximum axial accelerations are combined with the bottom hole assembly geometry, mass distribution and borehole inclination to calculate maximum stresses on individual tool components, their connections and any other design weak points while also accounting for the determined "static" weight-on-bit force.

Another embodiment uses the high frequency relative displacement information from the LVDT to control the MR valve 14 based upon the relative velocity between the bearing casing 50 and the bearing mandrel 52 such that the system damping coefficient when the Belleville spring stack compresses is different from the damping coefficient when the Belleville spring stack expands.

In some embodiments, the algorithm used to control the MR valve 14 uses the average WOB, or the relative velocity and/or relative acceleration between the bearing casing and the bearing mandrel, determined from the output of the LVDT. Additional inputs from other MWD sensors (e.g., angular acceleration, lateral vibration and/or bore pressure, etc.) could also be used in the damping algorithm.

Damping algorithms would automatically adjust the MR valve and damping coefficient of the drilling system. In some embodiments, the drill rig operator could communicate from the surface to the downhole controller 146 to change from one automatic damping algorithm to another algorithm that might be better suited to the current drilling environment (e.g., geology, trajectory, etc.).

Although the invention has been described with reference to the incorporation of an LVDT into the torsional bearing of a MR damping system, the invention is applicable to other situations in which the WOB results in axial displacement between two components in the drill string, such as conventional shock absorbers. Accordingly, the present invention may be embodied in other specific forms without departing from the spirit or essential attributes thereof and, accordingly, reference should be made to the appended claims, rather than to the foregoing specification, as indicating the scope of the invention.

What is claimed is:

1. In a drill string to which a drill bit is attached for drilling a bore hole in an earthen formation, a method for determining the weight applied to said drill bit, comprising the steps of:

sensing the relative displacement between a first component coupled to said drill bit and a second component in coaxial relationship with the first component, the first component configured to move axially in response to an axial motion of said drill bit, the first and second components containing a fluid there between, wherein the axial motion of said drill bit causes relative axial motion between said first and second components, so as to cause the relative displacement;

generating a signal representative of said sensed relative displacement;

causing a deflection of a spring, the spring operably connected to at least one of the first and second components, the spring configured to oppose said relative axial motion between said first and second components and generate a force in response to the deflection, the spring having a predetermined relationship between the deflection of said spring and the force generated by said spring when subject to the deflection;

determining the value of the force based on said signal representative of said sensed relative displacement and said predetermined relationship of the spring;

determining the value of the viscosity of the fluid;

determining the weight on said drill bit based upon the value of the force and the viscosity of the fluid.

2. The method for determining the weight applied to said drill bit according to claim 1, wherein said relative displacement is sensed by a transducer.

3. The method for determining the weight applied to said drill bit according to claim 2, wherein a controller is in electronic communication with the transducer, the controller including a processor, wherein the processor is configured to determine the weight on said drill bit based upon the value of the force and the viscosity of the fluid.

4. The method for determining the weight applied to said drill bit according to claim 1, wherein a drilling torque is transmitted to said drill bit by said first and second components.

5. The method for determining the weight applied to said drill bit according to claim 4, wherein said drill string comprises a torsional bearing, and wherein said first component is a casing of said torsional bearing and said second component is a mandrel of said torsional bearing.

6. The method for determining the weight applied to said drill bit according to claim 1, wherein said spring predetermined relationship is expressed as a ratio representative of the spring constant for said spring, and wherein the step of determining the value of the force comprises multiplying said spring constant by a value representative of a change in said sensed relative displacement.

7. The method for determining the weight applied to said drill bit according to claim 1, wherein the force is a first force, and wherein a change in said relative displacement between said first and second components is resisted by a second force proportional to the viscosity of said fluid, and wherein the step of determining the weight on said bit further comprises the step of adding the value of said second force to said first force.

8. The method for determining the weight applied to said drill bit according to claim 7, wherein said fluid is a magnetorheological fluid.

9. The method for determining the weight applied to said drill bit according to claim 8, further comprising subjecting said magnetorheological fluid to a magnetic field, and wherein the step of determining the viscosity of said magnetorheological fluid comprises determining the strength of said magnetic field.

10. The method for determining the weight applied to said drill bit according to claim 9, wherein said magnetic field is generated by applying an electrical current to at least one coil, and wherein the step of determining the strength of said magnetic field comprises determining the current applied to said coil.

11. The method for determining the weight applied to said drill bit according to claim 1, wherein the force is a first force, and wherein the fluid is a magnetorheological fluid, and the method further comprises subjecting said magnetorheological fluid to a magnetic field such that said relative displacement between said first and second components is resisted by a second force having a known relationship to the strength of said magnetic field, and wherein the step of determining the weight on said bit further comprises the step of adding the value of said second force to said first force.

12. The method for determining the weight applied to said drill bit according to claim 1, wherein the change in said relative displacement between said first and second components is resisted by a magnetic stiffness of the fluid, further comprising the step of determining the magnetic stiffness of the fluid.

13. The method for determining the weight applied to said drill bit according to claim 12, wherein the change in said relative displacement between said first and second components is resisted by a third force that is proportional to a magnetic stiffness of the fluid, and wherein the step of determining the weight on said bit further comprises the step of adding the value of said third force to said first force and said second force.

14. The method for determining the weight applied to said drill bit according to claim 1, wherein said spring predetermined relationship between the deflection of said spring and the force generated by said spring when the spring is subjected to deflection is substantially constant or non-linear.

15. In a drill string to which a drill bit is attached for drilling a bore hole in an earthen formation, the drill string comprising a bottom hole assembly and at least one threaded pipe connection, the bottom hole assembly being elongate along an axial direction a method for determining a force applied to the drill bit that is transmitted to said threaded pipe connection, comprising the steps of:

sensing, via at least one sensor incorporated into the bottom hole assembly, the acceleration of a first component along the axial direction, the first component being incorporated into said bottom hole assembly of said drill string;

sensing, via the at least one sensor, a relative displacement between said first component and a second component incorporated into said bottom hole assembly of said drill string, one of said first and second components coupled to said drill bit such that said one of the first and second components moves axially in response to a motion of said drill bit along the axial direction;

generating a signal representative of the relative displacement;

determining the value of the viscosity of a fluid disposed between said first and second components;

determining the weight applied to the drill bit based at least on the signal that is representative of the relative displacement and the viscosity of the fluid; and determining the force transmitted to the at least one threaded pipe connection based on a mass of the first component, the acceleration of the first component, and the determined weight applied to the drill bit.

16. The method for determining a force applied to the drill bit that is transmitted to said threaded pipe connection according to claim 15, wherein the fluid has a magnetic stiffness, and wherein the step of determining the weight on said drill bit is further based on the magnetic stiffness of the fluid.

17. The method for determining a force applied to the drill bit that is transmitted to said threaded pipe connection according to claim 15, wherein one of the at least one sensor is a transducer.

18. The method for determining a force applied to the drill bit that is transmitted to said threaded pipe connection according to claim 15, wherein a drilling torque is transmitted to said drill bit by said first and second components.

19. The method for determining a force applied to the drill bit that is transmitted to said threaded pipe connection according to claim 18, wherein said drill string comprises a torsional bearing configured to transmit the drilling torque to said drill bit, and wherein said torsional bearing comprises said first and second components.

20. The method for determining a force applied to the drill bit that is transmitted to said threaded pipe connection according to claim 19, wherein said first component is a bearing casing.

21. The method for determining a force applied to the drill bit that is transmitted to said threaded pipe connection according to claim 20, wherein said second component is a bearing mandrel disposed within said bearing casing.

22. The method for determining a force applied to the drill bit that is transmitted to said threaded pipe connection according to claim 15, further comprising causing a deflection of a spring, the spring operably connected to at least one of said first and second components, the spring configured to oppose said relative axial motion between said first and second components and generate a spring force in response to the deflection, the spring having a predetermined relationship between the deflection of said spring and the spring force generated by said spring when subject to the deflection.

23. The method for determining a force applied to the drill bit that is transmitted to said threaded pipe connection according to claim 22, wherein said spring predetermined relationship is expressed as a ratio representative of a spring constant for said spring, and wherein the step of determining the value of said spring force comprises multiplying said spring constant by a value representative of a change in said sensed relative displacement.

24. The method for determining a force applied to the drill bit that is transmitted to said threaded pipe connection according to claim 22, wherein a change in said relative displacement between said first and second components is resisted by a viscous force proportional to the viscosity of said fluid, and wherein the step of determining the weight on said drill bit further comprises the step of adding the value of said viscous force to said spring force.

25. The method for determining a force applied to the drill bit that is transmitted to said threaded pipe connection according to claim 24, wherein said fluid is a magnetorheological fluid.

26. The method for determining a force applied to the drill bit that is transmitted to said threaded pipe connection according to claim 25, further comprising subjecting said magnetorheological fluid to a magnetic field, and wherein the step of determining the viscosity of said magnetorheological fluid comprises determining the strength of said magnetic field.

27. The method for determining a force applied to the drill bit that is transmitted to said threaded pipe connection according to claim 26, wherein said magnetic field is generated by applying an electrical current to at least one coil, and wherein the step of determining the strength of said magnetic field comprises determining the current applied to said coil.

28. The method for determining a force applied to the drill bit that is transmitted to said threaded pipe connection according to claim 22, wherein the fluid is a magnetorheological fluid, and the method further comprises subjecting said magnetorheological fluid to a magnetic field such that said relative displacement between said first and second components is resisted by a viscous force having a known relationship to the strength of said magnetic field, and wherein the step of determining the weight on said bit further comprises the step of adding the value of said viscous force to said spring force.

* * * * *